US011214400B2

(12) United States Patent
Heynen

(10) Patent No.: US 11,214,400 B2
(45) Date of Patent: Jan. 4, 2022

(54) PACKAGE AND A SLIDE FOR SUCH A PACKAGE

(71) Applicant: ECOBLISS HOLDING B.V., Echt (NL)

(72) Inventor: Iwan Heynen, Maasbracht (NL)

(73) Assignee: ECOBLISS HOLDING B.V., Echt (NL)

( * ) Notice: Subject to any disclaimer, the term of this patent is extended or adjusted under 35 U.S.C. 154(b) by 174 days.

(21) Appl. No.: 16/440,835

(22) Filed: Jun. 13, 2019

(65) Prior Publication Data

US 2019/0382155 A1 Dec. 19, 2019

(30) Foreign Application Priority Data

Jun. 14, 2018 (CA) ..... 3008417

(51) Int. Cl.
*B65D 77/04* (2006.01)
*B65D 5/38* (2006.01)

(52) U.S. Cl.
CPC ..... *B65D 5/38* (2013.01); *B65D 77/0433* (2013.01); *B65D 2215/02* (2013.01)

(58) Field of Classification Search
CPC ... B65D 5/38; B65D 77/0433; B65D 2215/02
(Continued)

(56) References Cited

U.S. PATENT DOCUMENTS 3,261,458 A * 7/1966 Nibecker ..... B65D 77/22 206/221
3,850,333 A * 11/1974 Reichert ..... B65D 1/36 220/556

(Continued)

FOREIGN PATENT DOCUMENTS

CA 2109287 C 11/1998
CA 2966622 A1 6/2016

(Continued)

OTHER PUBLICATIONS

Office action from Canadian Patent Application No. 3,008,417 dated Oct. 11, 2019.

(Continued)

*Primary Examiner* — Luan K Bui
(74) *Attorney, Agent, or Firm* — Ladas & Parry, LLP

(57) ABSTRACT

A package comprises a housing and a slide. The slide is slidably accommodated in the housing in a sliding direction. The slide comprises a bottom wall, side walls connected to the bottom wall as well as at least one flange-shaped upper edge spaced from the bottom wall, which is connected to the side walls. The flange-shaped upper edge comprises two parts that extend parallel to the sliding direction. Each part is provided with at least one hook-shaped element. The housing comprises two side walls. Each side wall is provided with at least one recess in which one of the hook-shaped elements connected to the slide can be positioned for at least locking the slide in position in the housing The hook-shaped elements can be moved out of the recesses against spring force, after which the slide can be moved in the sliding direction in the housing. The slide is provided with a box being connected to the bottom wall of the slide. The box comprises walls located at a distance from the side walls of the slide. The walls of the box bound an opening being sealable by means of a foil.

14 Claims, 10 Drawing Sheets

(58) Field of Classification Search
USPC ..... 206/1.5, 468; 220/4.21, 4.23, 506, 553, 220/554, 555, 254.1; 229/125.125
See application file for complete search history.

(56) References Cited

U.S. PATENT DOCUMENTS 4,126,224 A * 11/1978 Laauwe ..... B65D 50/06 206/540
4,881,651 A * 11/1989 Mimoun ..... B43M 99/008 220/606
5,441,164 A * 8/1995 Beck ..... A47G 19/06 220/574
5,901,848 A * 5/1999 Gorlich ..... B65D 81/3294 206/439
6,354,456 B2 * 3/2002 Rapson ..... B65D 21/086 220/506
6,752,288 B1 * 6/2004 Swift ..... A47G 23/06 220/551
7,044,321 B2 * 5/2006 Smith ..... B65D 1/24 220/23.87
8,714,387 B2 5/2014 Davidson
9,278,792 B2 3/2016 Linssen
2016/0152373 A1 * 6/2016 Linssen ..... B65D 5/38 206/1.5

FOREIGN PATENT DOCUMENTS

EP 3016883 B1 3/2017
GB 2540100 A 1/2017

OTHER PUBLICATIONS

Office action from Canadian Patent Application No. 3,008,417 dated Jan. 20, 2020.

* cited by examiner

PACKAGE AND A SLIDE FOR SUCH A PACKAGE

CROSS-REFERENCE TO RELATED APPLICATIONS

The present application claims priority to Canadian patent application No. 3008417 filed on Jun. 14, 2018, the disclosure of which incorporated by reference in its entirety.

The invention relates to a package comprising a housing and a slide which is slidably accommodated in the housing in a sliding direction, which slide comprises a bottom wall, side walls connected to the bottom wall as well as at least one flange-shaped upper edge spaced from the bottom wall, which is connected to the side walls, wherein the flange-shaped upper edge comprises two parts that extend parallel to the sliding direction, wherein each part is provided with at least one hook-shaped element, whilst the housing comprises two side walls, wherein each side wall is provided with at least one recess in which one of the hook-shaped elements connected to the slide can be positioned for at least locking the slide in position in the housing, which hook-shaped elements can be moved out of the recesses against spring force, after which the slide can be moved in the sliding direction in the housing.

The invention also relates to a method for a slide for such a package.

BACKGROUND OF THE INVENTION

Such a package is known from EP3016883B1. It has the advantage that the package is child proof and senior friendly. Such package can be used for example to store medicines, such as tablets, packed in blister packs, wherein a number of blister packs are present in the slide.

The known slide does not provide means to close the slide itself, for example to be able to store perishable products directly in the slide.

SUMMARY OF THE INVENTION

At least one of the objects of the invention is to provide a package wherein the slide can easily be sealed whilst the hook-shaped elements can still be moved out of the recesses in the housing against spring force.

This object is accomplished with the package according to the invention in that the slide is provided with a box being connected to the bottom wall of the slide, which box comprises walls located at a distance from the side walls of the slide, which walls of the box bound an opening being sealable by means of a foil.

Since the box is connected to the bottom wall of the slide it can not be separated from the slide so that it will always automatically be located again in the housing, when the slide is moved back into the housing.

Furthermore, since the walls of the box are located at a distance from the side walls of the slide, the walls of the box will not hinder the hook-shaped elements provided on the parts of the flange-shaped upper edge, to be moved out of the recesses in the housing against spring force. Amongst others the flange-shaped upper edge as well as the walls of box can be optimized for its individual purpose.

For example, if a foil would be directly sealed to the flange-shaped upper edge, the flange-shaped upper edge should have a certain width to obtain a desired seal. Such width should be larger than the width needed for the parts of the flange-shaped upper edge to be able to move the hook-shaped elements against spring force of the parts. By the present invention the width of the edge of the box for sealing the foil can be optimized for its sealing function whilst the width of the parts of the flange-shaped upper edge can be optimized for its desired movement against spring force.

Due to the foil the content in the slide is protected against air. Furthermore, in case that small articles like powder are located in the slide, the powder is maintained safely within the slide by the foil.

An embodiment of the package according to the invention is characterized in that the bottom wall of the slide is connected to intermediate walls, which intermediate walls are connected at a side spaced from the bottom wall via a flange to the walls of the box, wherein the walls of the box at a side spaced from the flange are connected to a box bottom wall.

The opening of the box is located on the same side of the slide as the flange-shaped upper edge. A user can simply open the package by placing his hands on top of the housing, pressing the hook shaped elements against spring force and moving the slide with the opening of the box directed to the top of the housing out of the housing.

Another embodiment of the package according to the invention is characterized in that the foil covering the opening is sealed to the flange connecting the intermediate walls to the walls of the box.

The width of the flange can be simply optimized for its sealing function, being for example 5-6 millimetres.

Another embodiment of the package according to the invention is characterized in that the flange is located closer to the bottom wall of the slide than the flange-shaped upper edge.

In this manner it is ensured that the flange-shaped upper edge can be located against the inner side of the housing without being hindered by the flange of the box. Furthermore, this gives the possibility for the use of a cover to cover the opening after removal of the foil.

Another embodiment of the package according to the invention is characterized in that a cover for closing the opening of the box is pivotably connected to the flange-shaped upper edge.

Such cover can be used to cover the opening after removal of the foil. Since the cover is attached to the slide, a user will automatically use it, before sliding the slide into the housing. This easily prevents the products in the slide, to be spread throughout the housing and, in case of a power like product, to flow between the side walls and bottom wall of the slide and the housing.

Another embodiment of the package according to the invention is characterized in that the walls of the box are connected on one side to the bottom wall of the slide and at a side spaced from the bottom wall to a box bottom wall, whilst the opening is provided in the bottom wall of the slide.

The opening of the box is located on the same side of the slide as the bottom wall. A user can simply open the package by placing his hands on the bottom of the housing, pressing the hook shaped elements against spring force and moving the slide with the opening of the box directed to the top of the housing out of the housing.

Another embodiment of the package according to the invention is characterized in that the foil covering the opening is sealed to the bottom wall of the slide.

Since the foil is connected to the bottom wall of the slide, the foil will not hinder the hook shaped elements from being moved against spring force.

Another embodiment of the package according to the invention is characterized in that one side wall of the slide extending perpendicular to the sliding direction is provided with a pivotable flap, whilst the housing comprises a housing wall, which housing wall is provided with a pivotable part on a side extending perpendicular to the sliding direction, whereby in a position in which the slide is partly slit out of the housing in the sliding direction, the flap of the slide is located between the housing wall and the pivotable part of the housing wall of the housing, preventing the tray-shaped slide to slide fully out of the housing.

The pivotable part extends substantially parallel to the housing wall, leaving enough space between the pivotable part and the housing wall so that the flap of the slide will be caught between them. Due to such pivotable part in combination with the flap, the slide and the housing are connected to each other. Since all elements of the package are connected to each other, they form an immediate, or primary package as defined in the US PPPA (Poison Prevention Packaging Act).

Another embodiment of the package according to the invention is characterized in that seen in the sliding direction, the pivotable part of the housing wall of the housing is located at a front side of the housing, whilst the flap of the slide is located at a rear side of the slide.

Since the flap is located on the other side of the package than the pivotable part, the tray-shaped slide can be slit out of the housing over a relatively large distance before the flap of the tray-shaped slide is located between the top wall and the pivotable part of the top wall of the housing and the tray-shaped slide is being prevented to slide fully out of the housing.

Only the front side of the package can be opened to allow the slide to be slit partly out of the housing. The rear side of the package is preferably closed to prevent the slide to be slit out through the rear side.

Another embodiment of the package according to the invention is characterized in that the pivotable flap is connected to the slide at an opposite side of the slide as the pivotable cover.

In this manner the slide can easily be produced in a single mould.

Another embodiment of the package according to the invention is characterized in that a recess and a hook-shaped element located at a first side wall are staggered, seen in the sliding direction, relative to a recess and a hook-shaped element located at a second side wall, wherein the hook-shaped elements of the flange-shaped upper edge can be moved out of the recesses against the spring force of the flange-shaped upper edge.

Because the hook-shaped elements are staggered, it will be virtually impossible for a young child of about 4 years old to place its fingers so that both staggered hook-shaped elements are removed simultaneously, against spring force, from the likewise staggered recesses.

According to European and US legislation, a package may be called childproof if it meets the EN/ISO 8317 standard and the US 16 CRF 1700.20 standard, respectively. Both standards prescribe extensive testing both with seniors (50-70 years old) and with children aged about 4 years. The tests are carried out by certified (ISO 17025) test agencies. It has been found that the package according to the invention is able to meet the prevailing standards.

Another embodiment of the package according to the invention is characterized in that a diagonal line between the staggered recesses in the two side walls includes an angle of at most 60 degrees with the side wall.

The smaller the angle between the diagonal line and the side wall provided with the recess, the more difficult it will be to open the package. With a package of a particular width, the diagonal distance between the staggered recesses and the hook-shaped elements positioned therein will be larger in the case of a smaller angle than in the case of a larger angle. If the angle is too small, it will be difficult for adults, and certainly also for seniors, to open the package. Consequently, the angle is preferably larger than 20 degrees.

Another embodiment of the package according to the invention is characterized in that the staggered recesses in the two side walls are spaced a distance of at least 60 mm apart, seen in a direction parallel to the side wall.

The greater the distance, the more difficult it will be to open the package. If the distance is too great, it will be difficult for adults, and certainly also for seniors, to open the package. Consequently, the distance is preferably less than 120 mm.

Another embodiment of the package according to the invention is characterized in that the hook-shaped element has a barb-like configuration.

The barb-like configuration makes it impossible to depress the hook-shaped element whilst the slide is being pulled at. This makes it impossible to pull at the slide and subsequently depress the hook-shaped elements one by one and remove them from the recesses. The barb-like configuration forces the user to depress both hook-shaped elements simultaneously.

Another embodiment of the package according to the invention is characterized in that the hook-shaped element lies in the same plane as the part of the flange-shaped upper edge that extends parallel to the sliding direction.

Such a hook-shaped element is easy to form in the flange-shaped upper edge, for example by punching. The hook-shaped element will in that case have the same relatively small thickness as the flange-shaped upper edge. In this way the recess present in the housing can likewise have a relatively small dimension in the thickness direction of the hook-shaped element. As a result, the strength of the housing will remain practically unchanged in spite of the presence of the recess therein.

Another embodiment of the package according to the invention is characterized in that the slide is made of plastic material, using a thermoforming process.

This is a relatively inexpensive manner of producing the slide. When a thermoforming process is used, the flange-shaped upper edge must be punched to the desired dimensions after the forming of the slide. During this usual punching operation, the hook-shaped element is simultaneously formed on the flange-shaped upper edge by means of a punching operation. As a result, additional operations for providing the slide with the hook-shaped elements are not needed.

BRIEF DESCRIPTION OF THE DRAWINGS

The package according to the invention will further be explained with reference to the drawings, wherein.

In the drawings, like reference numerals refer to like elements.

DESCRIPTION OF PREFERRED EMBODIMENTS

Figure 1:
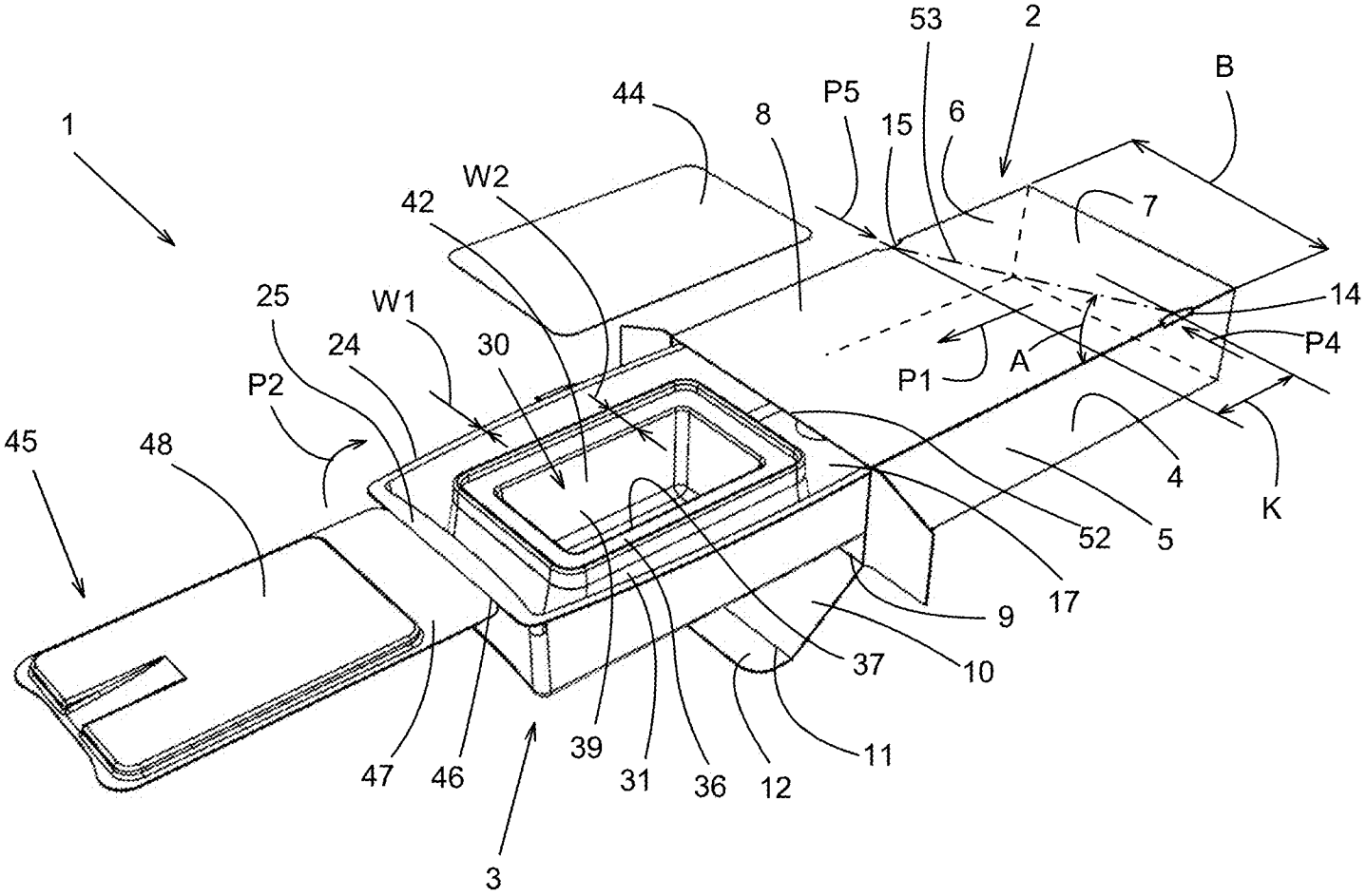
FIG. 1 is a perspective view of a first embodiment of a package according to the invention.
Figure 2A:
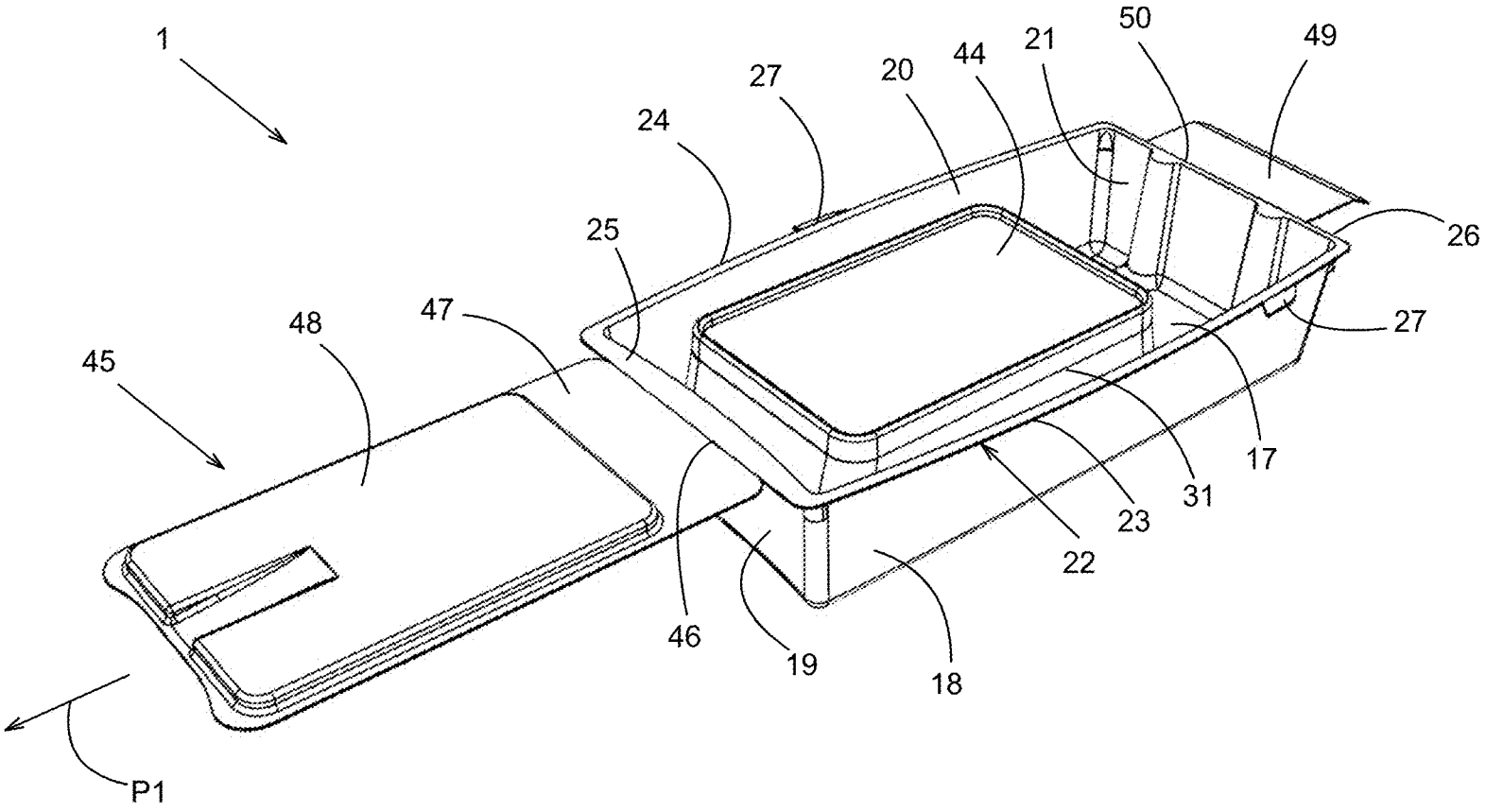
FIGS. 2A and 2B are is a perspective view and a perspective cross section of a slide of the package as shown in FIG. 1, with an open position of a cover and with a sealed foil in FIG. 2A and with a remove foil in FIG. 2B.
Figure 2B:
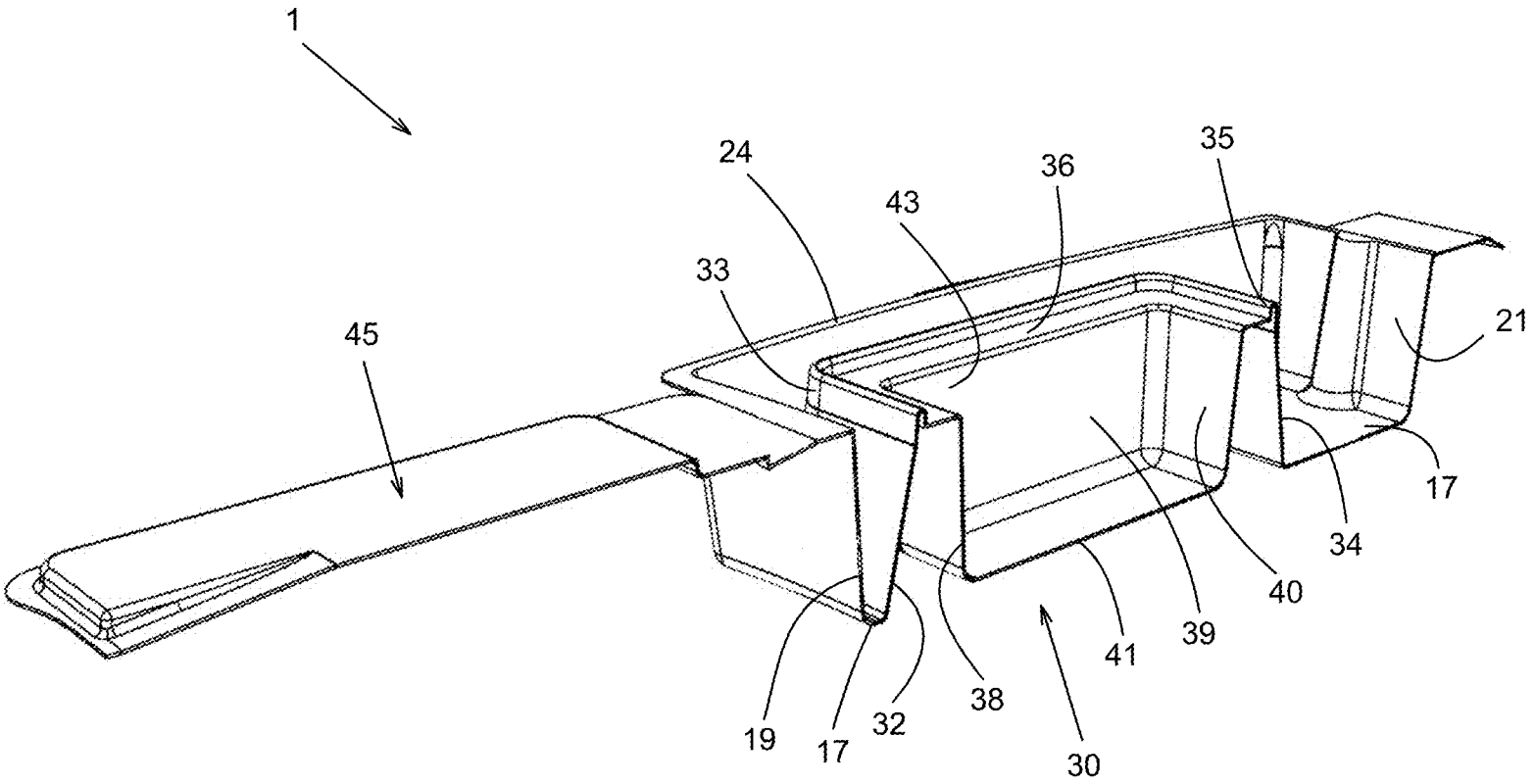
Figure 3:
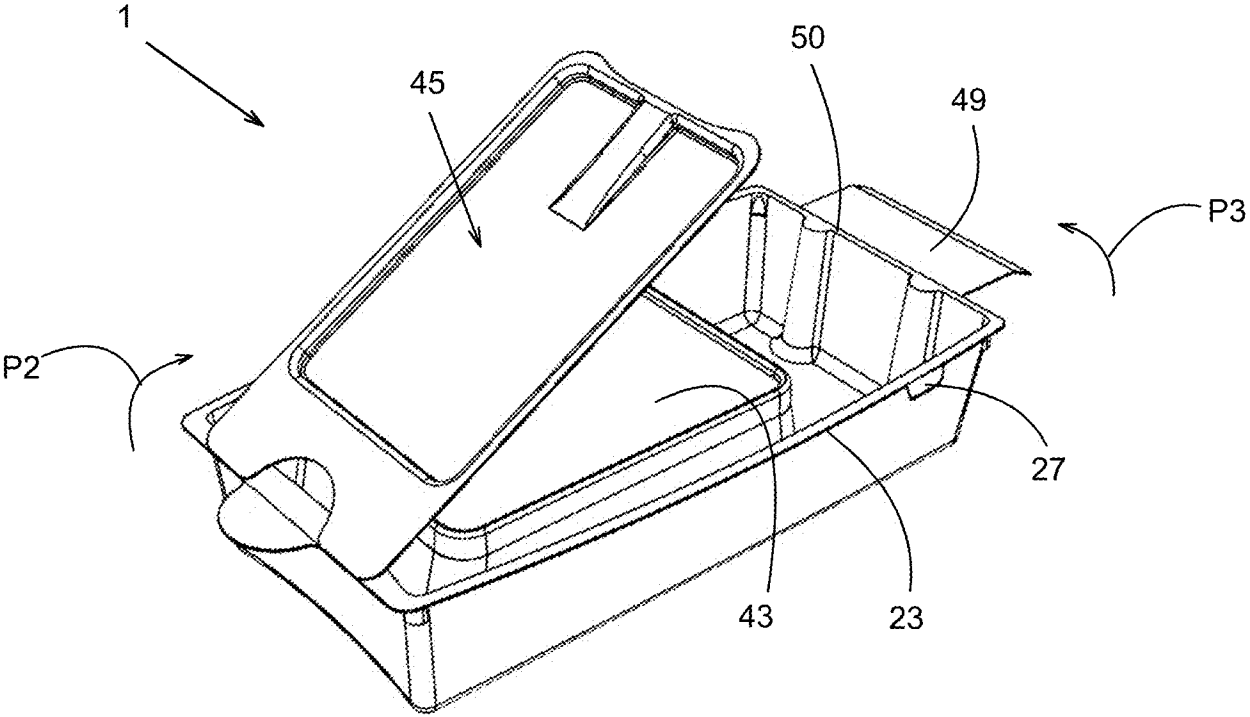
FIG. 3 is a perspective view of a slide of the package as shown in FIG. 1, with an intermediate position of the cover and with the sealed foil.

FIGS. 1-6 show different views of a first embodiment of a package 1 according to the invention. The package 1 comprises a cardboard housing 2 and a stray shaped slide 3 of plastic material, which is slidably accommodated, in and opposite to the direction indicated by arrow P1, in the housing 2. The housing 2 comprises a bottom side 4, side walls 5, 6 extending transversely to the bottom side, a rear wall 7 extending transversely to the bottom side 4 and the side walls 5, 6, an upper wall 8 extending parallel to the bottom side 4, and a flap 10 which is pivotally connected about a pivot line 9 to the bottom side. The flap 10 is provided with a flap portion 12 which is pivotable about a pivot line 11, which flap portion 12 can be positioned to abut against the upper wall 8 on an inner side thereof. Such a rectangular housing 2 is known per se and will not be discussed in more detail herein, therefore.

The housing 2 is provided with a pair of recesses 14, 15, which extend through the side of the side walls 5, 6 that faces the upper wall 8 and the sides of the upper wall 8 that face the side walls 5, 6. The part of the recesses 14, 15 that is provided in the side walls 5, 6 is rectangular in shape. The part of the recesses 14, 15 that is provided in the upper wall 8 is arcuate in shape. The recess 14 in side wall 5 is located closer to the rear wall 7 than recess 15 in side wall 6, so that the recess 14, of the first side wall 5 is staggered relative to the recess 15 of the second side wall 6 in the sliding direction indicated by the arrow P1.

The slide 3 comprises a bottom wall 17 and side walls 18, 19, 20, 21 extending along the circumference of the bottom wall 17, which each include an angle slightly greater than 90 degrees with the bottom wall 17. The slide 3 further comprises a flange-shaped, endless upper edge 22, spaced from the bottom wall 17, which is connected to the side walls 18, 19, 20, 21. The upper edge 22 comprises two parts 23, 24 extending parallel to the sliding direction indicated by the arrow P1, as well as two parts 25, 26 extending transversely to the sliding direction indicated by the arrow P1. The part 25 is wider than the part 26. The parts 23, 24 have a width W1 of a few millimetres. The parts 23, 24 each comprise a hook-shaped element 27, spaced from the wider part 25.

The hook-shaped elements 27 are staggered in the sliding direction indicated by the arrow P1, similarly to the recesses 14, 15 of the housing 2. In a direction transversely to the bottom wall 17, the hook-shaped element 27 has the same thickness as the upper edge 22. The hook-shaped elements 27 lie in the same plane as the part 23, 24 of the flange-shaped upper edge 22 that extends parallel to the sliding direction P1.

Figure 4:
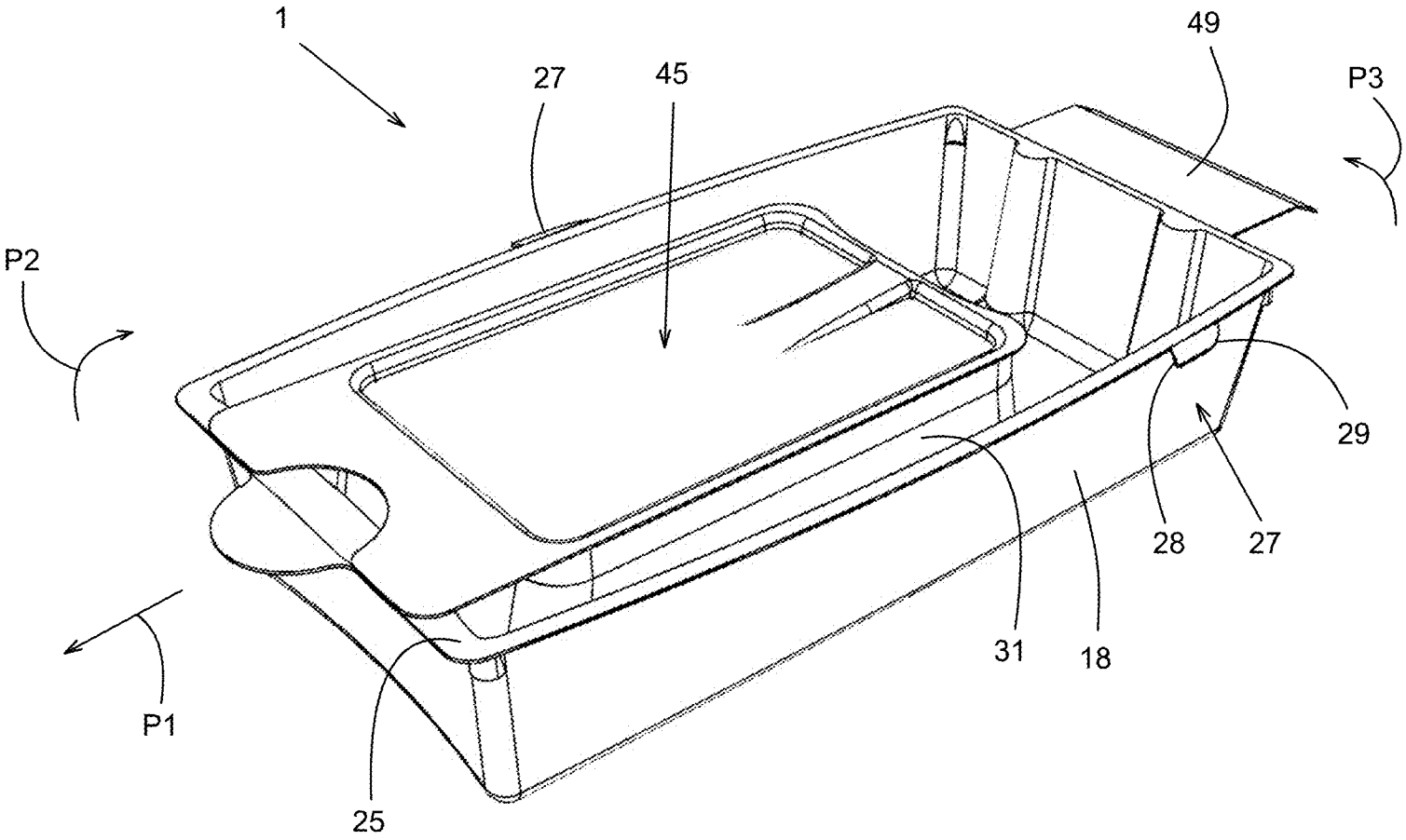
FIG. 4 is a perspective view of a slide of the package as shown in FIG. 1, with a closed position of the cover, with the sealed foil and with a flap in an initial position.
Figure 5:
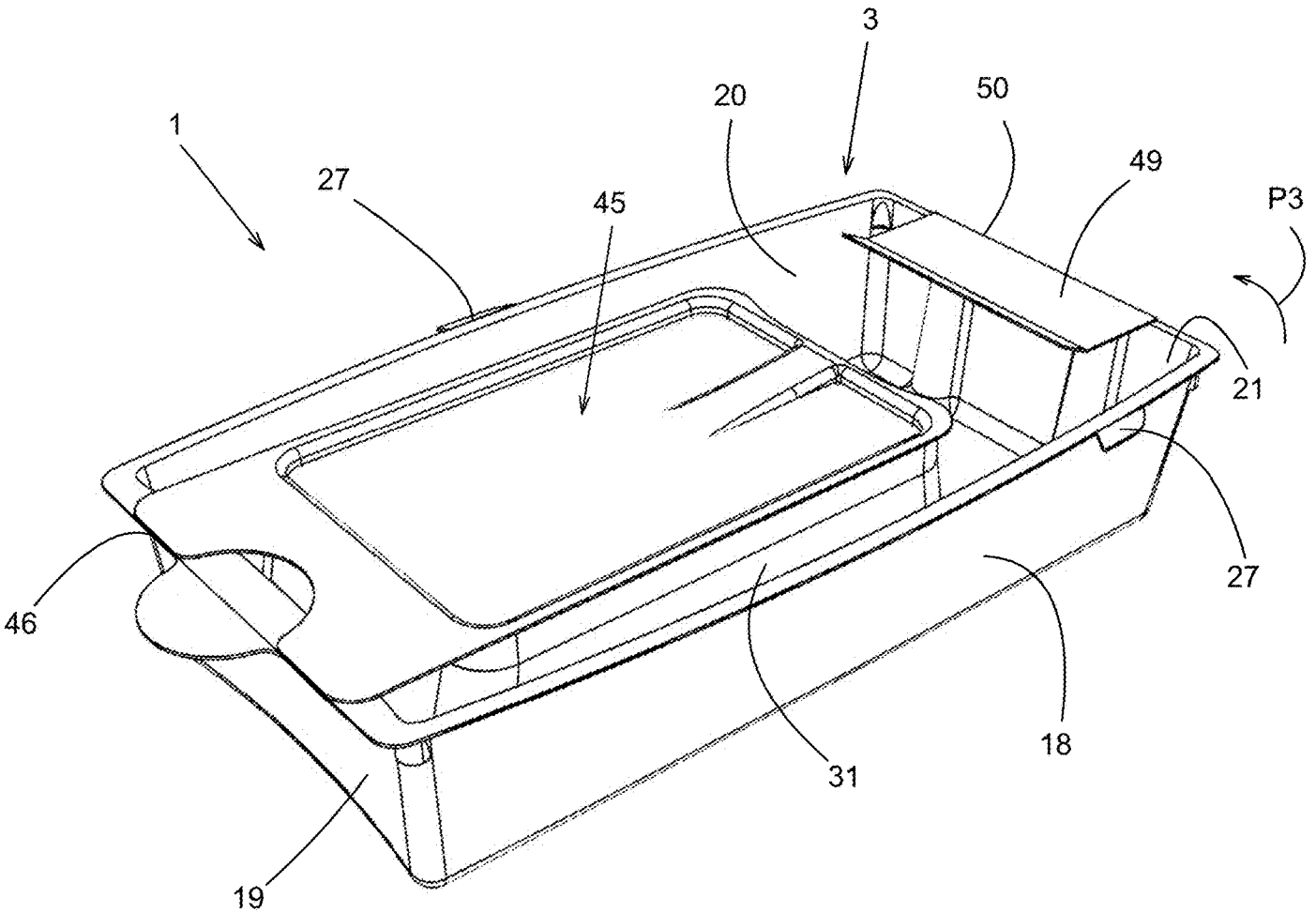
FIG. 5 is a perspective view of a slide of the package as shown in FIG. 1, with a closed position of the cover, with the sealed foil and with the flap in its operational position.

As is clearly shown in FIG. 4, the hook-shaped element 27 comprises a wall portion 28 extending transversely to the sliding direction indicated by the arrow P1 and a curved wall portion 29 connecting thereto, providing the hook-shaped element with a barb-like configuration. The wall portion 28 is located on a side of the hook-shaped element 27 that faces the wider part 25. The hook-shaped element 27 and the recesses 14, 15 are dimensioned so that the hook-shaped element 27 fits in the recesses 14, 15, with the wall portion 28 abutting against an edge of the side wall 5, 6 that bounds the recess 14, 15.

The slide as described above is known from EP3016883B1.

The slide 3 according to the invention also comprises a box 30 being connected to the bottom wall 17 of the slide 3.

The box 30 comprises intermediate walls 31, 32, 33, 34 connected to the bottom wall 17 of the slide 3 and spaced apart from the side walls 18, 19, 20, 21. At a side remote of the bottom wall 17, the intermediate walls 31, 32, 33, 34 are connected via a circumferential flange 36 to walls 37, 38, 39, 40 of the box 30. The flange 36 has a width W2 being larger than the width W1 of the parts 23, 24. The width W2 is for example 5-7 millimetres.

The walls 37, 38, 39, 40 of the box 30 are connected to a box bottom wall 41 at a side spaced from the flange 36. Spaces between the side walls 18, 19, 20, 21 and the intermediate walls 31, 32, 33, 34 as well as the spaces between the intermediate walls 31, 32, 33, 34 and the walls 37, 38, 39, 40 of the box 30 are V-shaped so that the slide 3 comprising the box 30 can easily be made by thermoforming, for example.

At a side remote of the box bottom wall 41, the walls 37, 38, 39, 40 bound an opening 43 providing access to the box 30. The opening 43 can be closed by sealing a foil 44 to the flange 36.

The flange 36 is located closer to the bottom wall 17 of the slide 3 than the flange-shaped upper edge 22.

The slide 3 is also provided with a cover 45 for closing the opening 43 of the box 30 after removal of the foil 42. The cover 45 is pivotably connected along pivot line 46 to part 25 of the flange-shaped upper edge 22 and can be pivoted in and opposite the direction as indicated by arrow P2, from an open position (see FIG. 1), via an intermediate position (see FIG. 3) to a closed position (see FIGS. 4 and 5), and vice versa.

The cover 45 comprises a flat part 47 and a raised part 48, which raised part 48 is dimensioned to fit between the ridge 35 and onto the flange 36.

At a rear side the slide 3 is provided with a flap 49 being pivotably connected along pivot line 50 to part 26 of the flange-shaped upper edge 22 and can be pivoted in and opposite the direction as indicated by arrow P3, from an initial position (see FIGS. 3 and 4) to an operational position (see FIG. 5), and vice versa. The pivotable flap 49 is connected to the slide 3 at an opposite side of the slide 3 as the pivotable cover 45.

Figure 6:
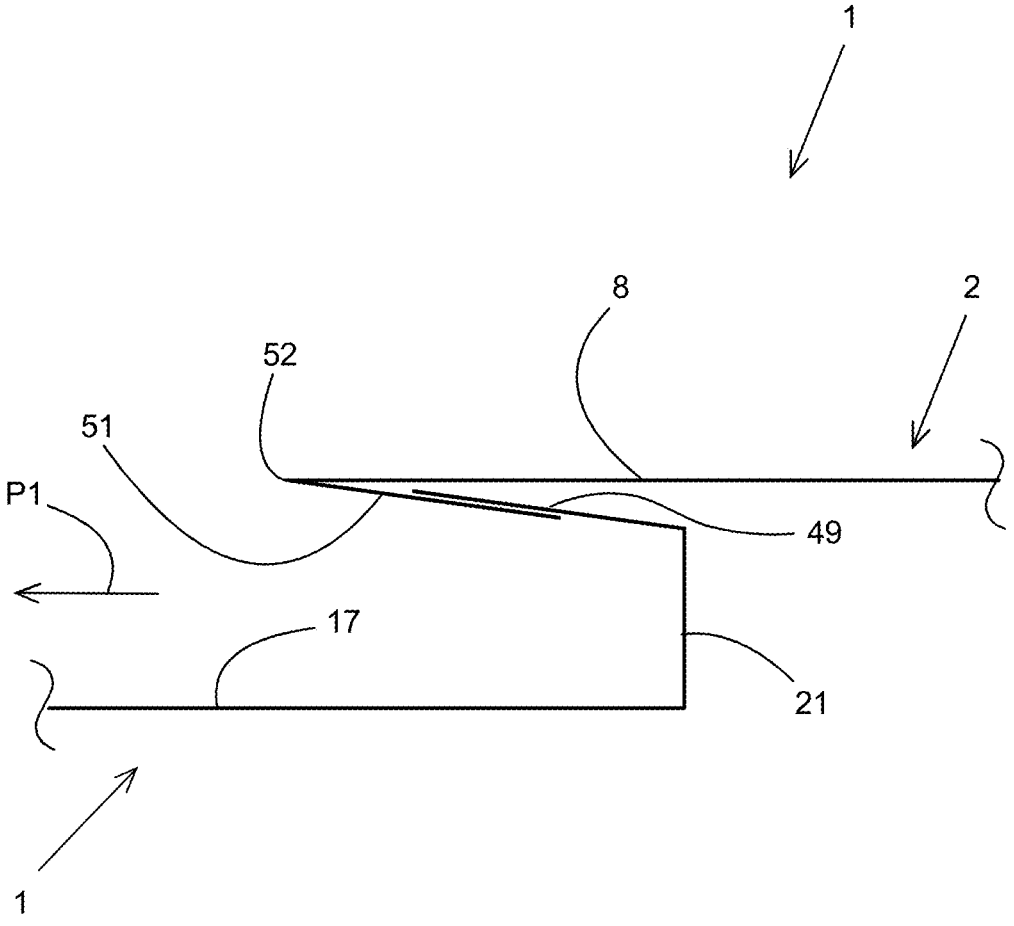
FIG. 6 is a schematic cross section of the package as shown in FIG. 1 in a position wherein the slide is slit out of the housing as far as possible.

As can be seen in FIG. 6, the upper wall 8 of the housing 2 is provided with a pivotable part 51 being pivotably connected along pivot line 52 to the upper part 8. The pivot line 52 extends perpendicular to the sliding direction P1. In a position in which the slide 3 is partly slit out of the housing 2 in the sliding direction P1, the flap 49 of the slide 3 is located between the upper wall 8 of the housing wall 2 and the pivotable part 51 of the housing 2, preventing the slide 3 to slide fully out of the housing 2.

The operation of the package 1 is as follows.

In a closed position of the package 1, the slide 3 is fully enclosed within the housing 2, and the flap 10 is in the closed position. The slide 3 is now hidden from view and access to the products present therein, such as loose medicines, is not possible. In the closed position, the hook-shaped elements 27 of the slide 3 are positioned in the recesses 14, 15 of the housing 2.

When a user wishes to take products from the slide 3, the flap portion 12 is first pivoted about the pivot line 9. Then the user presses on the hook-shaped elements 27 positioned in the staggered recesses 14, 15 in the directions indicated by the arrows P4, P5 with two fingers, for example the thumb and the index finger. The directions indicated by the arrows P4, P5 extend transversely to the sliding direction indicated by the arrow P1. The fingers are thus positioned in the arcuate parts of the recesses 14, 15 in the upper wall 8. The staggered hook-shaped elements are moved out of the recesses 14, 15 in the directions indicated by the arrows P4, P5, against spring force and under elastic deformation of the side walls 18, 20 and the parts 23, 24, with the wall portions 28 moving clear of the side walls 5, 6 in question. Using his other hand, the user then takes hold of the wider part 25 of the upper edge 22 and/or part 47 of the cover 45, which are freely accessible, whereupon the user moves the slide 3 out of the housing 2, in the direction indicated by the arrow P1, to the position shown in FIG. 1. The user may then pivot the cover 45 in a direction opposite to arrow P2 to the open position as shown in FIG. 1. Next, the foil 44 can be removed to gain access through the opening 43 to the inside of the box 30. The products (not shown) present in the box 30 can now be removed from the box 30.

If a relatively young child undesirably attempts to open the package 1, it will presumably be able to open the flap 10. The child will then pull at the wider part 25 of the upper edge 22, which is freely accessible through the opening of the housing 2. However, because the wall portions 28 of the hook-shaped elements 27 abut against the edge 30 of the side walls 5, 6 moving the slide 3 out of the housing 2 is prevented in a simple manner.

A diagonal line 53 is drawn between the staggered recesses 14, 15. Said line is not present on the actual package 1 but is only shown by way of illustration of the invention. The diagonal line 53 between the staggered recesses 14, 15 in the two side walls 5, 6 includes an angle A at most 60 degrees and at least 20 degrees with the side wall 5, 6. The staggered recesses 14, 15 are spaced apart by a distance K of at least 60 mm and at most 120 mm in a direction parallel to the side walls 5, 6. When such dimensions are used, the width B of the package 1 will range between 35 mm and 120 mm, and the length of the diagonal line 53 will range between 70 mm and 140 mm.

It is also possible to use different materials for the slide and the housing, such as plastics suitable for thermoforming or injection-moulding, cardboard, especially tear-resistant cardboard, or a metal such as aluminium.

Figure 7:
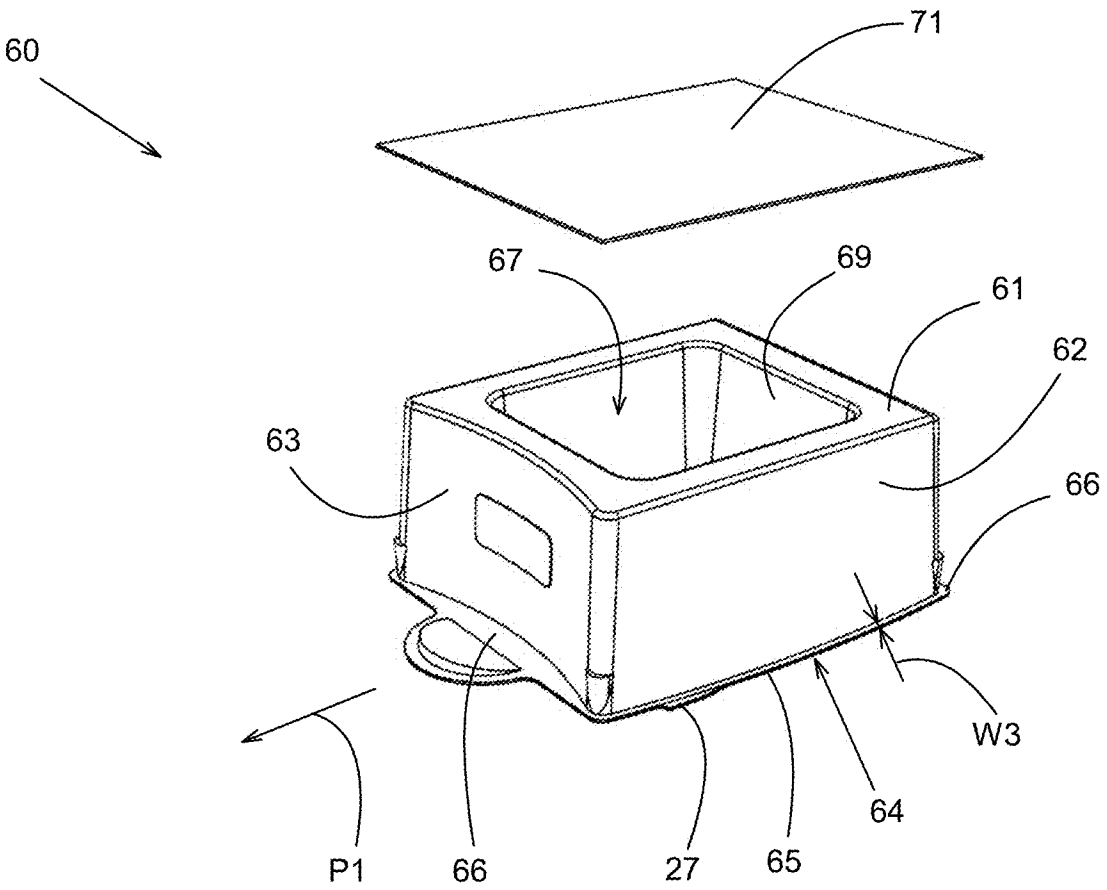
FIG. 7 is a perspective view of a second embodiment of a package according to the invention.
Figure 8:
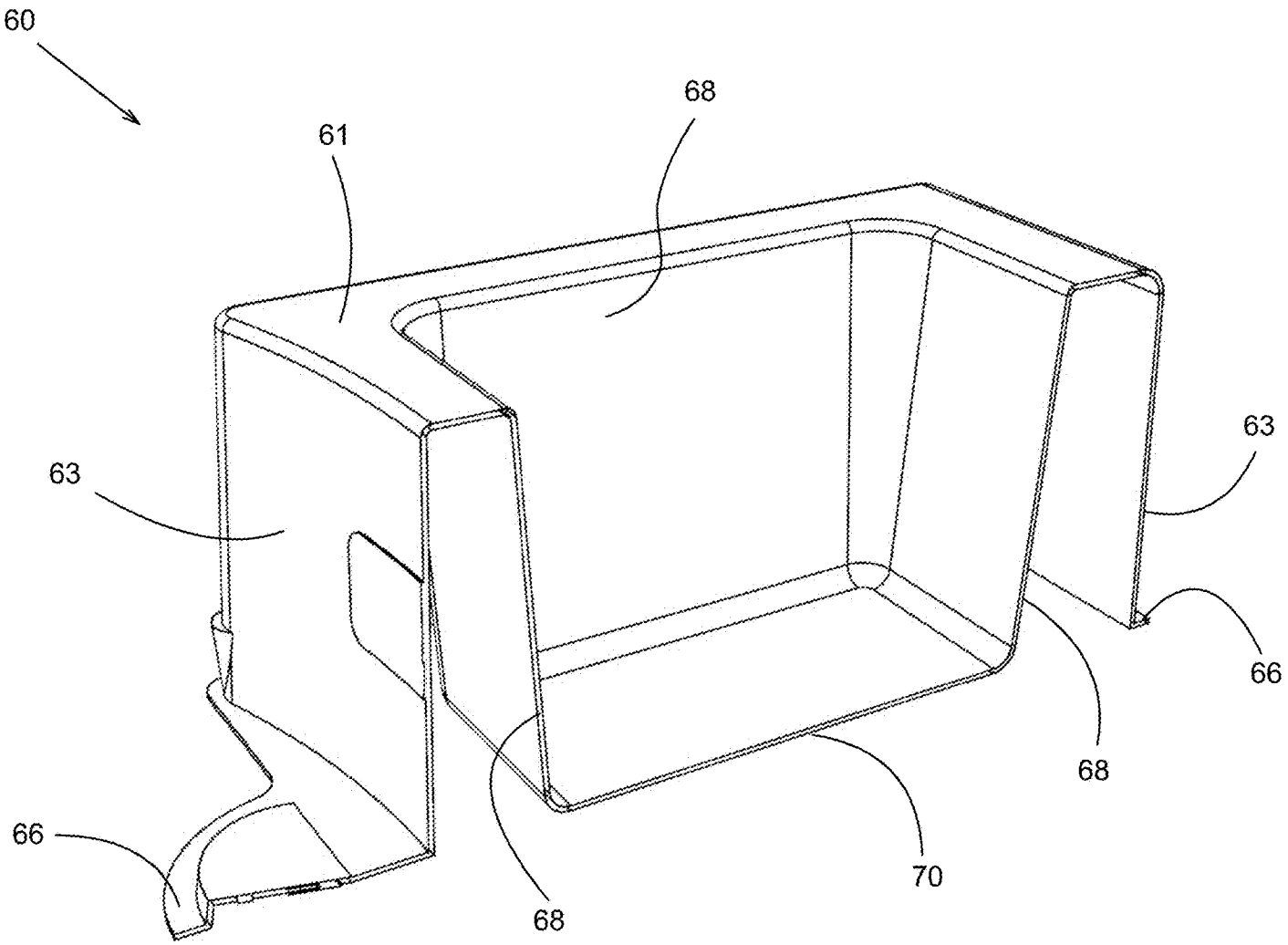
FIG. 8 is a perspective cross section of a slide of the package as shown in FIG. 7 with a remove foil.
Figure 9:
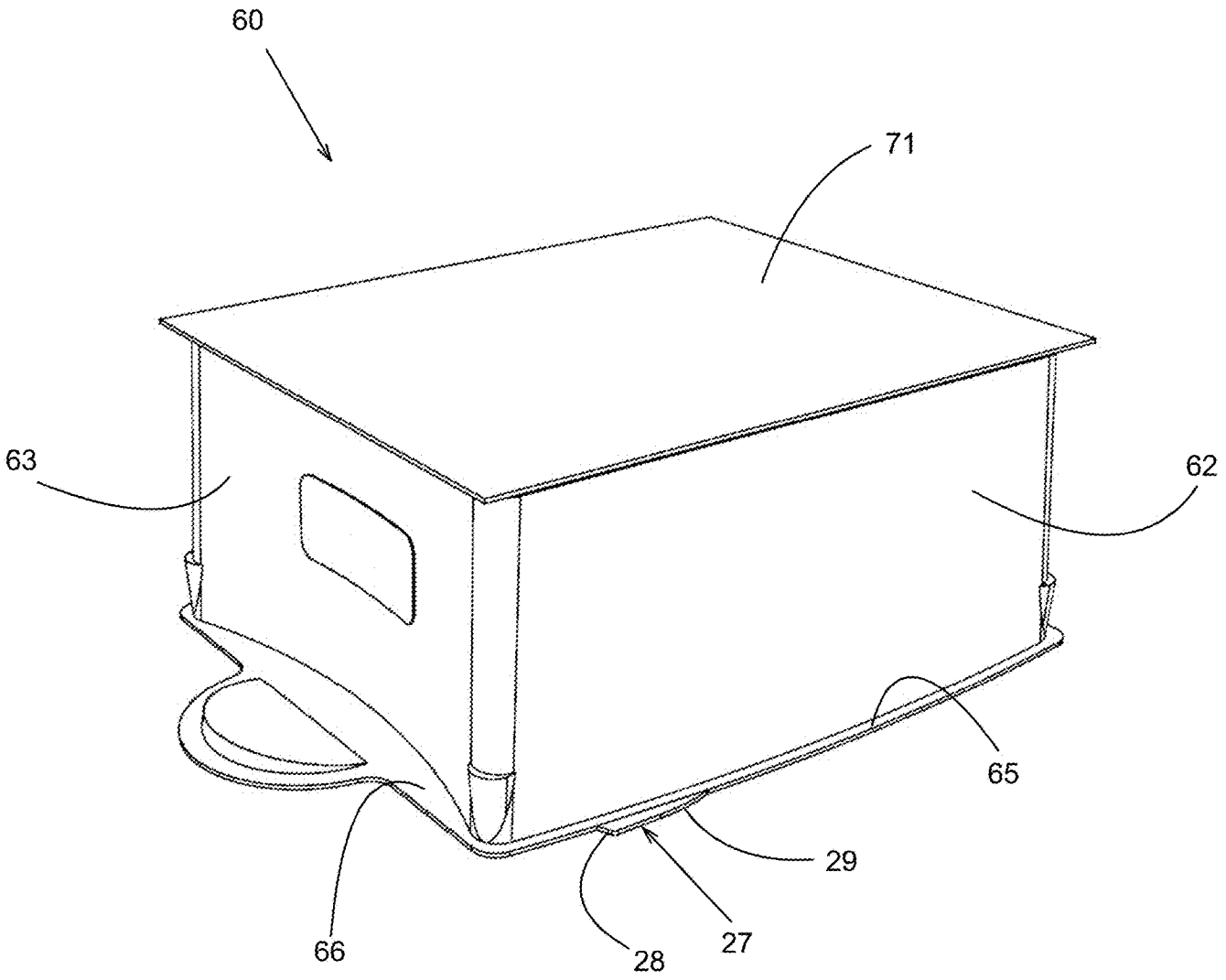
FIG. 9 is a perspective view of a slide of the package as shown in FIG. 7 with a sealed foil.

FIGS. 7-9 show different views of a second embodiment of a package 1 according to the invention, which differs from the first embodiment in that a different slide 60 is being used. For ease of the description the same words like "bottom wall", "upper wall" etcetera are being used as with reference to slide 3. However, by the slide 60 the orientation in use is reversed.

The slide 60 comprises a bottom wall 61 and two pair of side walls 62, 63 extending along the circumference of the bottom wall 61, which each include an angle slightly greater than 90 degrees with the bottom wall 61. The slide 60 further comprises a flange-shaped, endless upper edge 64, spaced from the bottom wall 61, which is connected to the side walls 62, 63. The upper edge 64 comprises two parts 65 extending parallel to the sliding direction indicated by the arrow P1, as well as two parts 66 extending transversely to the sliding direction indicated by the arrow P1. The parts 66 are wider than the parts 65. The parts 65 having a width W3 of a few millimetres.

Each part 65 comprises a hook-shaped element 27, spaced from the wider part 66. The hook-shaped elements 27 are staggered in the sliding direction indicated by the arrow P1, similarly to the recesses 14, 15 of the housing 2. In a direction transversely to the bottom wall 61, the hook-shaped element 27 has the same thickness as the upper edge 64. The hook-shaped elements 27 lie in the same plane as the flange-shaped upper edge 64 that extends parallel to the sliding direction P1.

The slide 3 is provided with a box 67 comprising walls 68 extending along the circumference of an opening 69 in the bottom wall 61. The walls 68 of the box 67 are connected on one side to the bottom wall 61 of the slide 60 and at a side spaced from the bottom wall 61 to a box bottom wall 70. Spaces between the side walls 62, 63 and the walls 68 of the box 67 are V-shaped so that the slide 60 comprising the box 67 can easily be made by thermoforming, for example.

The opening 69 in the bottom wall 61 can be sealed by a foil 71 being connected to the bottom wall 61 of the slide 60.

In use, the slide 60 will be used with the bottom wall 61 directed upwards and the flange-shaped, endless upper edge 64 located below the bottom wall 61, as shown in the FIGS. 7-9. Also the housing 2 will be used upside down compared with the first embodiment, whereby the recesses 14, 15 will be located in the lower wall instead of in the upper wall. The hook-shaped elements 27 will cooperate with the recesses 14, 15 in said lower wall. A user will need to put his hand under the package to be able to press both hook-shaped elements 27 at the same time into the housing 2. Subsequently be can pull at the part 66, remove the foil 71 and gain access to the inside of the box 67 through opening 69.

The slide 3, 60 is preferably made of a plastic material, such as PVC, ABS, PE, PET, PS and PP, to be deformed by means of a thermoforming process. After thermoforming of the slide 3 has taken place, the hook-shaped elements 27 are punched into the upper edge 22, 64, with the desired dimensions of the parts 23, 24, 25, 26, 65, 66 being obtained by said the punching operation. The bottom wall 17, 61, the side walls 18, 19, 20, 21, 62, 63 and the upper edge 22, 64 are relatively thin, so that the parts 23, 24, 65 of the upper edge 22, 64 that are provided with the hook-shaped elements 27 can be moved toward each other against the spring force of the material of the slide 3, 60. If desired the walls of the box 30, 67 can be thicker.

The dimensions of the cardboard housing 2 can vary from, for example, a width of 21 to 151 mm, a height of 51 to 101 mm and a length of 51 to 301 mm. The wall thickness of the housing 2 can vary from 400 to 1000 micron, for example.

The dimensions of the slide 3, 60 can vary from, for example, a width of 20 to 150 mm, a height of 50 to 100 mm and a length of 50 to 300 mm. The wall thickness of the slide 3, 60 can vary from 200 to 1000 micron, for example.

LIST OF REFERENCE SIGNS

1 package
2 housing

3 slide
4 bottom wall
5 side wall
6 side wall
7 rear wall
8 upper wall
9 pivot line
10 flap
11 pivot line
12 flap portion
14 recess
15 recess
17 bottom wall
18 side wall
19 side wall
20 side wall
21 side wall
22 upper edge
23 part
24 part
25 part
26 part
27 hook-shaped element
28 wall portion
29 wall portion
30 box
31 intermediate wall
32 intermediate wall
33 intermediate wall
34 intermediate wall
35 ridge
36 flange
37 wall
38 wall
39 wall
40 wall
41 box bottom wall
43 opening
44 foil
45 cover
46 pivot line
47 flat part
48 raised part
49 flap
50 pivot line
51 pivotable part
52 pivot line
53 diagonal line
60 slide
61 bottom wall
62 side wall
63 side wall
64 upper edge
65 part
66 part
67 box
68 wall
69 opening
70 bottom wall
71 foil
P1 arrow
P2 arrow
P3 arrow
P4 arrow
P5 arrow
W1 width
W2 width
W3 width
A angle
K distance
B width

The invention claimed is:

1. A package comprising:

a housing and a slide which is slidably accommodated in the housing in a sliding direction, which slide comprises: a bottom wall, side walls connected to the bottom wall as well as at least one flange-shaped upper edge spaced from the bottom wall, which is connected to the side walls, wherein the flange-shaped upper edge comprises two parts that extend parallel to the sliding direction, wherein each part is provided with at least one hook-shaped element, whilst the housing comprises two side walls, wherein each side wall is provided with at least one recess in which one of the hook-shaped elements connected to the slide can be positioned for at least locking the slide in position in the housing, which hook-shaped elements are movable out of the recesses against spring force, and when the hook-shaped elements are moved out of the recesses, the slide is movable in the sliding direction in the housing, wherein the slide is provided with a box being connected to the bottom wall of the slide, which box comprises walls located at a distance from the side walls of the slide, which walls of the box bound an opening being sealable by means of a foil, and wherein:

the bottom wall of the slide is connected to intermediate walls, which intermediate walls are connected at a side spaced from the bottom wall via a flange to the walls of the box, the walls of the box at a side spaced from the flange are connected to a box bottom wall, and the flange is located closer to the bottom wall of the slide than the flange-shaped upper edge.

2. A package according to claim 1, wherein the foil covering the opening is sealed to the flange connecting the intermediate walls to the walls of the box.

3. A package according to claim 1, wherein a cover for closing the opening of the box is pivotably connected to the flange-shaped upper edge.

4. A package according to claim 1, wherein one side wall of the slide extending perpendicular to the sliding direction is provided with a pivotable flap, whilst the housing comprises a housing wall, which housing wall is provided with a pivotable part on a side extending perpendicular to the sliding direction, whereby in a position in which the slide is partly slit out of the housing in the sliding direction, the flap of the slide is located between the housing wall and the pivotable part of the housing wall of the housing, preventing the slide to slide fully out of the housing.

5. A package according to claim 4, wherein seen in the sliding direction, the pivotable part of the housing wall of the housing is located at a front side of the housing, whilst the flap of the slide is located at a rear side of the slide.

6. A package according to claim 4, wherein the pivotable flap is connected to the slide at an opposite side of the slide as the pivotable cover.

7. A package according to claim 1, wherein a recess and a hook-shaped element located at a first side wall are staggered, seen in the sliding direction, relative to a recess and a hook-shaped element located at a second side wall, wherein the hook-shaped elements of the flange-shaped upper edge can be moved out of the recesses against the spring force of the flange-shaped upper edge.

8. A package according to claim 7, wherein a diagonal line between the staggered recesses in the two side walls includes an angle of at most 60 degrees with the side wall.

9. A package according to claim 7, wherein the staggered recesses in the two side walls are spaced a distance of at least 60 mm apart, seen in a direction parallel to the side wall.

10. A package according claim 1, wherein each of the hook-shaped elements has a barb-like configuration.

11. A package according to claim 1, wherein the hook-shaped element lies in the same plane as the part of the flange-shaped upper edge that extends parallel to the sliding direction.

12. A package according to claim 1, wherein the slide is made of plastic material, using a thermoforming process.

13. A package according claim 1, wherein no foil is connected to the flange-shaped upper edge.

14. A slide suitable for a package according to claim 1, said slide comprises: a bottom wall, side walls connected to the bottom wall as well as at least one flange-shaped upper edge spaced from the bottom wall, which is connected to the side walls, wherein the flange-shaped upper edge comprises two parts that extend parallel to the sliding direction, wherein each part is provided with at least one hook-shaped element, which hook-shaped elements are movable against spring force, wherein the slide is provided with a box being connected to the bottom wall of the slide, which box comprises walls located at a distance from the side walls of the slide, which walls of the box bound an opening being sealable by means of a foil, and wherein:

the bottom wall of the slide is connected to intermediate walls, which intermediate walls are connected at a side spaced from the bottom wall via a flange to the walls of the box, the walls of the box at a side spaced from the flange are connected to a box bottom wall, and the flange is located closer to the bottom wall of the slide than the flange-shaped upper edge.

* * * * *